US009920975B2

(12) United States Patent
Kim et al.

(10) Patent No.: US 9,920,975 B2
(45) Date of Patent: Mar. 20, 2018

(54) REFRIGERATOR

(71) Applicant: SAMSUNG ELECTRONICS CO., LTD., Suwon-si, Gyeonggi-do (KR)

(72) Inventors: Sang Bum Kim, Gwangmyeong-si (KR); Kyung Mok Yoo, Suwon-si (KR); Hyun Joo Kim, Suwon-si (KR); Kwang Su Heo, Yongin-si (KR); Eung Ryeol Seo, Suwon-si (KR); In-Yong Hwang, Hwaseong-si (KR); Ji Hoon Choi, Yongin-si (KR); Jeong Hoon Kang, Seoul (KR); Mi Jung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 17 days.

(21) Appl. No.: 15/294,084

(22) Filed: Oct. 14, 2016

(65) Prior Publication Data

US 2017/0108266 A1 Apr. 20, 2017

(30) Foreign Application Priority Data

Oct. 15, 2015 (KR) ..... 10-2015-0144357

(51) Int. Cl.
*A47B 96/04* (2006.01)
*F25D 21/04* (2006.01)
(Continued)

(52) U.S. Cl.
CPC ..... *F25D 21/04* (2013.01); *F25D 11/02* (2013.01); *F25D 23/069* (2013.01); *F25D 23/04* (2013.01);
(Continued)

(58) Field of Classification Search
CPC ..... F25D 23/069; F25D 23/04; F25D 25/005; F25D 25/02; F25D 11/02; F25D 11/04; F25D 21/04; F25D 2400/06
(Continued)

(56) References Cited

U.S. PATENT DOCUMENTS 3,835,660 A * 9/1974 Franck ..... F25D 21/04 312/296
3,868,152 A * 2/1975 Dixon ..... F25D 23/06 217/131
(Continued)

FOREIGN PATENT DOCUMENTS

EP 2762814 8/2014
JP 2000-213853 8/2000
(Continued)

OTHER PUBLICATIONS

International Search Report dated Dec. 14, 2016 from International Patent Application No. PCT/KR2016/011562, 3 pages.

*Primary Examiner* — Daniel J Troy
*Assistant Examiner* — Timothy M Ayres
(74) *Attorney, Agent, or Firm* — Staas & Halsey LLP

(57) ABSTRACT

A refrigerator includes a mid-frame positioned on a front surface of the main body wall and a heater configured to heat the mid-frame and provided at the mid-frame. The mid-frame includes a front frame provided to cover at least a part of a front surface of the at least one inner box configured to form the main body wall, and an extension frame formed to extend rearward from the front frame and including an edge portion in which an end portion of the extension frame has a thickness greater than that of an adjacent extension frame.

17 Claims, 18 Drawing Sheets

(51) Int. Cl.

| | |
|---|---|
| ***F25D 11/02*** | (2006.01) |
| ***F25D 23/06*** | (2006.01) |
| *F25D 23/04* | (2006.01) |
| *F25D 25/00* | (2006.01) |
| *F25D 25/02* | (2006.01) |

(52) U.S. Cl.
CPC ..... *F25D 25/005* (2013.01); *F25D 25/02* (2013.01); *F25D 2400/06* (2013.01)

(58) Field of Classification Search
USPC ..... 312/406
See application file for complete search history.

(56) References Cited

U.S. PATENT DOCUMENTS 4,150,518 A * 4/1979 Truesdell ..... F25D 21/04 220/592.08
4,881,315 A * 11/1989 Powell ..... F16B 5/125 24/457
4,884,415 A * 12/1989 Mandel ..... F25D 21/04 312/405
5,255,531 A * 10/1993 Williams ..... F25D 23/028 312/406
6,266,970 B1 * 7/2001 Nam ..... F25D 21/04 312/406
6,393,855 B1 5/2002 Schuchert et al.
8,083,305 B2 * 12/2011 Lee ..... F25D 23/087 312/296
9,243,835 B2 * 1/2016 Jeon ..... F25D 21/04
2003/0127956 A1 * 7/2003 Stoever ..... A47B 47/02 312/257.1
2010/0199708 A1 8/2010 Eckartsberg et al.
2015/0135761 A1 * 5/2015 Jang ..... F25D 21/04 62/441

FOREIGN PATENT DOCUMENTS

| | | |
|---|---|---|
| JP | 2007-218509 | 8/2007 |
| JP | 2007-263389 | 10/2007 |
| JP | 2008-175467 | 7/2008 |
| JP | 2013-113481 | 6/2013 |
| KR | 2000-0006395 | 4/2000 |
| KR | 10-2006-0062056 | 6/2006 |
| KR | 10-2006-0093762 | 8/2006 |
| KR | 10-0850955 | 8/2008 |
| KR | 10-2009-0020403 | 2/2009 |
| KR | 10-2011-0042786 | 4/2011 |

* cited by examiner

REFRIGERATOR

CROSS-REFERENCE TO RELATED APPLICATIONS

This application claims the priority benefit of Korean Patent Application No. 10-2015-0144357, filed on Oct. 15, 2015, in the Korean Intellectual Property Office, the disclosure of which is incorporated herein by reference in its entirety.

BACKGROUND

1. Field

Embodiments of the disclosure relate to a refrigerator, and more particularly, to a refrigerator in which a heat transfer structure is improved.

2. Description of the Related Art

Generally, a refrigerator lowers a temperature therein for freezing food or storing food under refrigeration by discharging cooling air generated by a refrigeration cycle performed by a compressor, a condenser, an expansion valve, an evaporator, and the like.

Because it is vitally important for such a refrigerator to maintain the temperature in the refrigerator at a low temperature, gaskets are installed at inside edges of doors so as to prevent the cooling air discharged into the refrigerator from leaking to the outside of the refrigerator and to prevent external heat of the refrigerator from transferring into the refrigerator.

Because an inside of a storage compartment of the refrigerator is provided to maintain a low temperature lower than that of the outside of the refrigerator, a dew condensation phenomenon occurs around doors of the refrigerator at which the storage compartment meets the outside of the refrigerator.

Because of such a dew condensation phenomenon, unnecessary moisture is accumulated on a surface of the refrigerator, and thus an aesthetically and sanitarily bad effect occurs.

SUMMARY

Additional aspects and/or advantages will be set forth in part in the description which follows and, in part, will be apparent from the description, or may be learned by practice of the invention.

Therefore, it is an aspect of the disclosure to provide a refrigerator in which energy efficiency is increased.

It is another aspect of the disclosure to provide a refrigerator that minimizes heat penetration to an inside thereof.

It is still another aspect of the disclosure to provide a refrigerator in which a dew condensation phenomenon of the outside of the refrigerator is prevented.

Additional aspects of the disclosure will be set forth in part in the description which follows and, in part, will be apparent from the description, or may be learned by practice of the disclosure.

In accordance with one aspect of the disclosure, a refrigerator may include a refrigerator main body including at least one inner box configured to form a storage compartment, a main body wall in which an insulating member is filled, the at least one inner box forming at least one surface of the main body wall, a mid-frame positioned on a front surface of the main body wall and a heater configured to heat the mid-frame and provided at the mid-frame, wherein the mid-frame may include a front frame provided to cover at least a part of a front surface of the at least one inner box configured to form the main body wall; and an extension frame formed to extend rearward from the front frame and including an edge portion in which an end portion of the extension frame has a thickness greater than that of an adjacent extension frame.

The edge portion may include a bent portion formed by being bent such that the end portion of the extension frame overlaps itself.

The mid-frame may include an inner box insertion space which is formed between a rear surface of the front frame and an inner surface of the mid-frame in a direction in which the extension frame is bent, and into which a part of the at least one inner box is inserted, and the edge portion is formed to face the inner box insertion space.

The at least one inner box may include an inner box coupling portion positioned in front of the main body wall and inserted into the inner box insertion space, and the edge portion is provided to support a rear surface of the inner box coupling portion.

The at least one inner box may include an inner box coupling portion positioned in front of the main body wall and inserted into the inner box insertion space, and the extension frame may include an extending portion bent from the front frame and configured to extend rearward and an extension in which the edge portion is formed at an end portion thereof, and which is bent from the extending portion and faces a rear surface of the inner box coupling portion.

The edge portion may include a bent portion formed by being bent such that the end portion of the extension overlaps itself.

The bent portion is formed by being bent to overlap itself in a first direction which is a front direction of the front frame.

The bent portion is formed to be folded so as to overlap itself in a rear direction of the front frame.

The bent portion is disposed closer to the front frame than the extension.

The bent portion is formed to have a longitudinal direction which is the same as that of the extension.

At least a part of the bent portion is in contact with a rear surface of the at least one inner box.

The extension frame is formed in at least a partial section of an entire section of the front frame in a longitudinal direction.

The mid-frame may include a first section in which the extension frame is formed behind the front frame in a longitudinal direction of the front frame and a second section which is adjacent to the first section in the longitudinal direction and in which the extension frame is not formed. The first section and the second section are repeatedly formed behind the front frame.

In accordance with another aspect of the disclosure, a refrigerator may include a refrigerator main body including a plurality of inner boxes respectively configured to form a freezer compartment and a refrigerator compartment, an intermediate partition formed by filling an insulating member between the plurality of inner boxes, a mid-frame positioned on a front surface the intermediate partition and a heater configured to heat the mid-frame and provided at the mid-frame. The mid-frame may include a front frame provided to cover at least parts of front surfaces of the inner boxes forming the intermediate partition, bent portions in which end portions thereof overlap themselves and a pair of extension frames formed to extend rearward from the front frame.

The mid-frame may include a pair of inner box insertion spaces which are formed between a rear surface of the front frame and an inner surface of the mid-frame in directions in which the pair of extension frames are bent and into which parts of the plurality of inner boxes are inserted and the bent portions are formed to face the pair of inner box insertion spaces.

The plurality of inner boxes include first and second inner box coupling portions positioned in front of the intermediate partition and inserted into the pair of inner box insertion spaces and the bent portions of the pair of extension frames support rear surfaces of the first and second inner box coupling portions.

In accordance with a further aspect of the disclosure, a refrigerator may include a refrigerator main body including a plurality of inner boxes configured to form a storage compartment, an intermediate partition formed by filling an insulating member between the plurality of inner boxes configured to form the storage compartment, a mid-frame positioned on a front surface of the intermediate partition, a heater configured to heat the mid-frame and provided at the mid-frame and a presser configured to press the heater such that the heater is pressed against the mid-frame.

At least a part of the presser is fixed to the mid-frame and the presser presses the heater toward the mid-frame.

The presser is detachably provided at the mid-frame.

The mid-frame may include a front frame configured to cover at least a part of a front surface of the intermediate partition and an extension frame which is formed to extend rearward from the front frame and in which the presser is installed.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
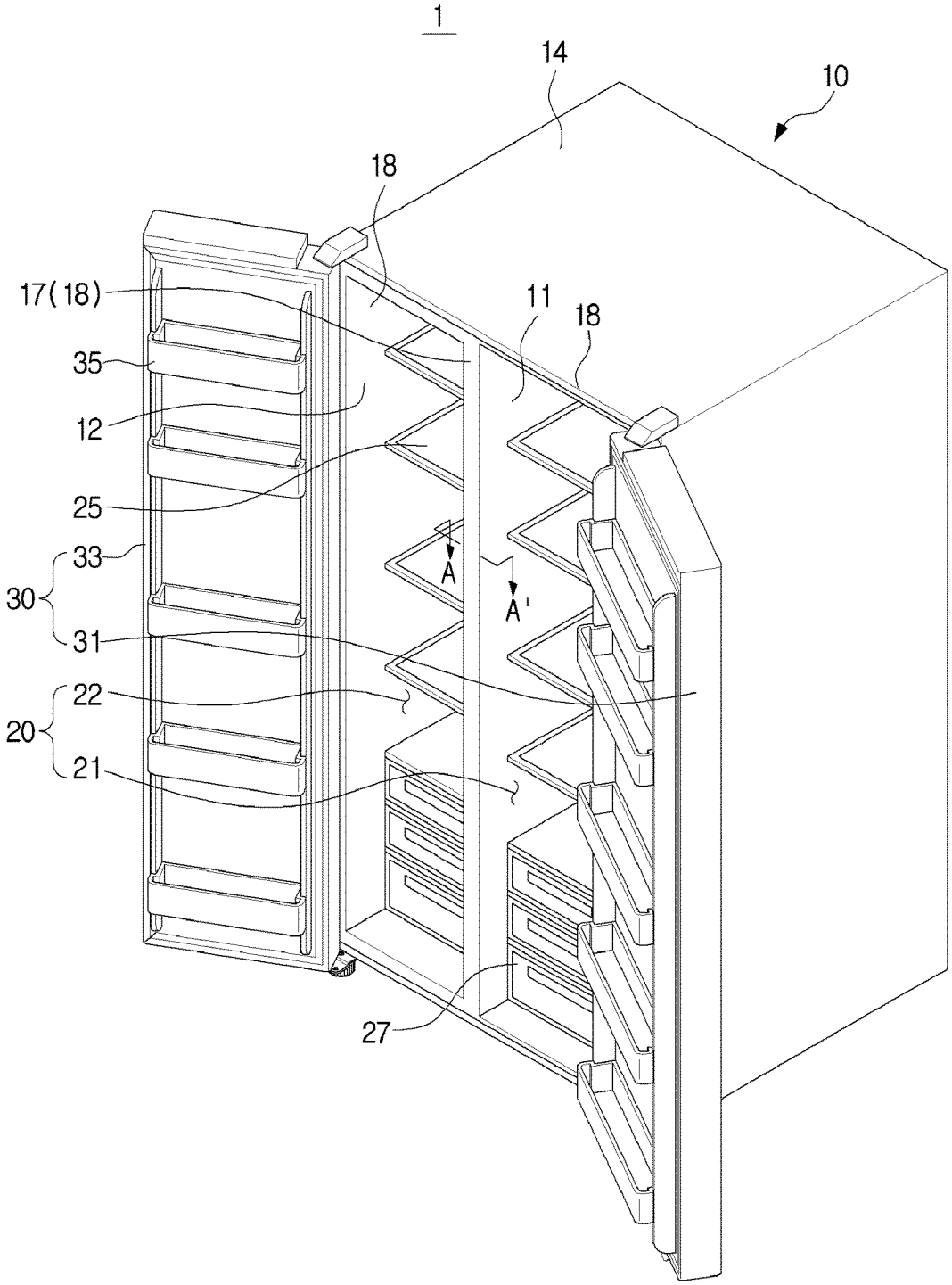
FIG. 1 is a perspective view illustrating a refrigerator according to one embodiment of the disclosure.

Reference will now be made in detail to embodiments, examples of which are illustrated in the accompanying drawings, wherein like reference numerals refer to like elements throughout. The embodiments are described below to explain the disclosure by referring to the figures.

Embodiments described in this disclosure and configurations illustrated in drawings are only exemplary examples of the disclosed disclosure. The disclosure covers various modifications that can substitute for the embodiments and drawings herein at the time of filing of this application.

In addition, the same reference numerals or symbols refer to parts or components that substantially perform the same function.

In addition, the terms used in the disclosure are merely used to describe exemplary embodiments, and are not intended to limit and/or restrict embodiments. An expression used in the singular encompasses the expression of the plural unless it has a clearly different meaning in context. In the disclosure, the terms such as "including," "having," and "comprising" are intended to indicate the existence of the features, numbers, steps, actions, components, parts, or combinations thereof disclosed in the disclosure, and are not intended to preclude the possibility that one or more other features, numbers, steps, actions, components, parts, or combinations thereof may exist or may be added.

In addition, it should be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the disclosure. As used herein, the term "and/or" includes any and all combinations of one or more of the associated listed items.

Hereinafter, embodiments of the disclosure will be described with reference to accompanying drawings in detail.

Figure 2:
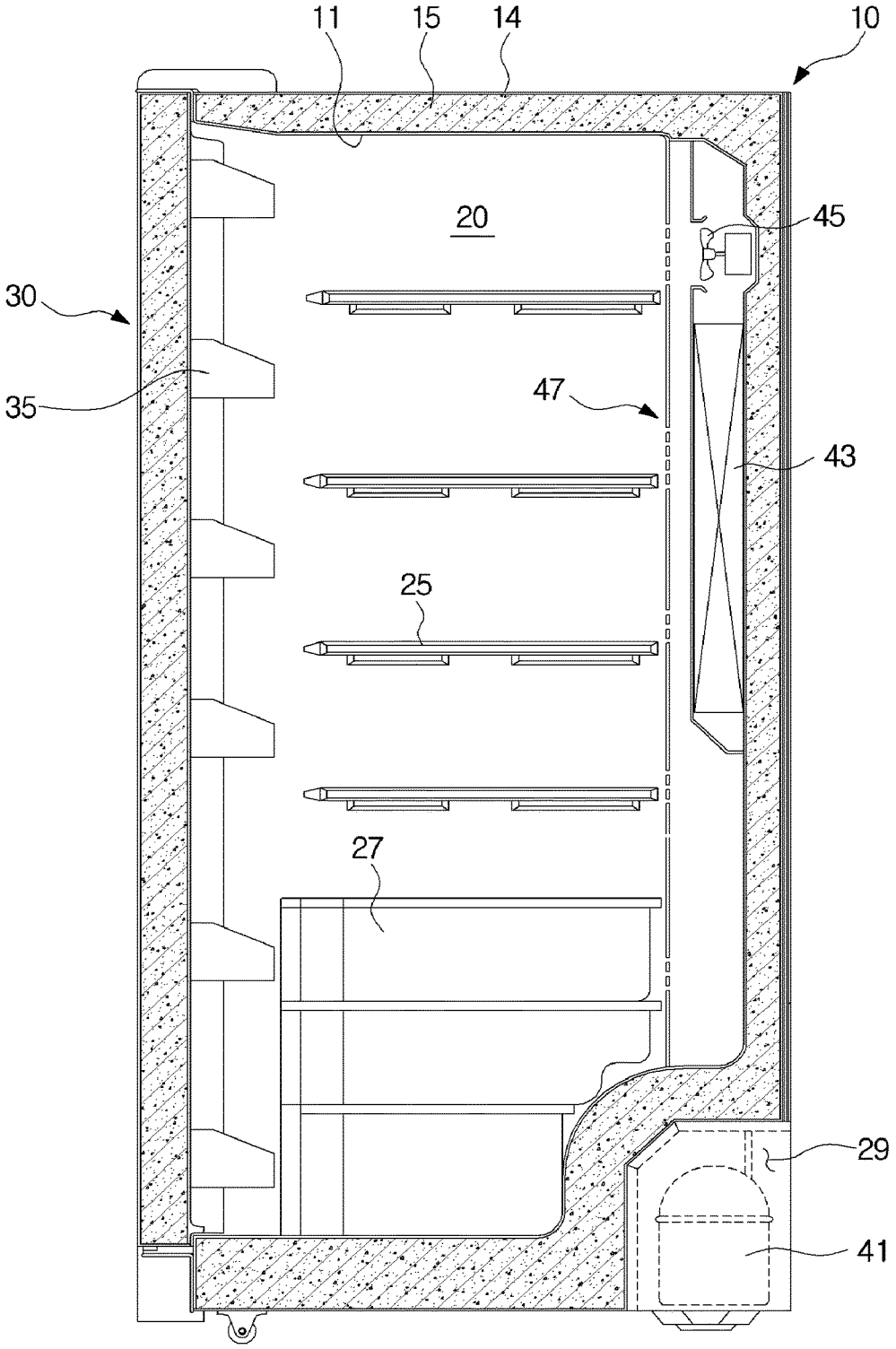
FIG. 2 is a cross-sectional view illustrating the refrigerator according to an embodiment of the disclosure.

FIG. 1 is a perspective view illustrating a refrigerator according to one embodiment of the disclosure, and FIG. 2 is a cross-sectional view illustrating the refrigerator according to one embodiment of the disclosure.

A refrigerator 1 may include a main body 10 configured to form an exterior, a storage compartment 20 provided in the main body 10 and having an open front, and doors 30 pivotably coupled to the main body 10 and configured to open or close the open front of the storage compartment 20.

The main body 10 may include an inner box 11 forming the storage compartment 20 and an outer box 14 forming an exterior. An insulating member is foamed between the inner box 11 and the outer box 14 to prevent cooling air in the storage compartment 20 from leaking. The inner box 11 is provided to have the storage compartment 20 of the refrigerator 1 at an inside thereof.

In addition, the main body 10 may include an intermediate partition 17 configured to laterally divide the storage compartment 20 into a refrigerator compartment 21 and a freezer compartment 22, and a machine compartment 29, in which a compressor 41 configured to compress a refrigerant and a condenser configured to condense the compressed refrigerant are installed is provided, at a lower-rear side of the main body 10.

The storage compartment 20 is laterally divided by the intermediate partition 17, the refrigerator compartment 21 is provided at the right in the main body 10, and the freezer compartment 22 is provided at the left in the main body 10.

A plurality of shelves 25 and storage containers 27 may be provided inside the storage compartment 20 so as to store food and the like.

The storage compartment 20 is opened or closed by the doors 30 pivotably coupled to the main body 10, and the refrigerator compartment 21 and the freezer compartment 22 laterally divided by the partition are opened or closed by a refrigerator compartment door 31 and a freezer compartment door 33, respectively.

A plurality of door guards 35 are provided at rear surfaces of the refrigerator compartment door 31 and the freezer compartment door 33 so as to store food and the like.

A cooling air supplying apparatus may include the compressor 41 and the condenser (not shown) installed in the machine compartment 29, an evaporator 43 installed behind the storage compartment 20 and configured to generate cooling air, a blower fan 45 provided above the evaporator 43 and configured to induce the cooling air generated by the evaporator 43 to be supplied to the storage compartment 20, and a cooling air duct 47 configured to guide the cooling air induced by the blower fan 45 to the storage compartment 20 and to discharge the cooling air to the storage compartment 20.

Figure 3:
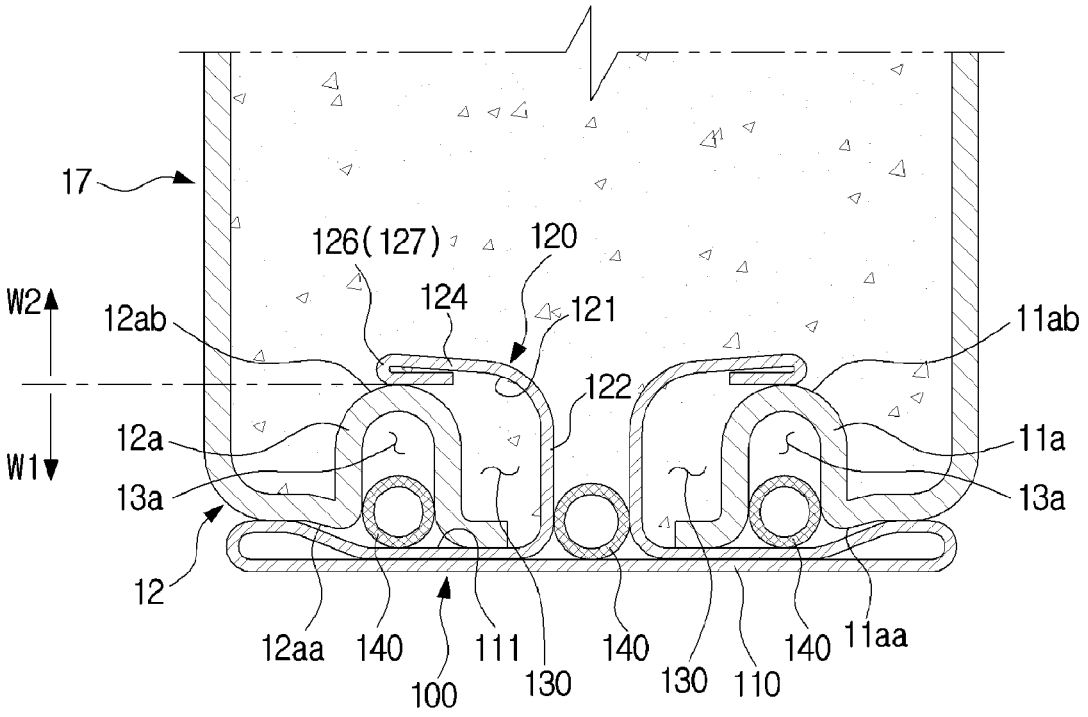
FIG. 3 is a cross-sectional view taken along line A-A' of FIG. 1.

FIG. 3 is a cross-sectional view taken along line A-A' of FIG. 1.

The intermediate partition 17 configured to divide the refrigerator compartment 21 and the freezer compartment 22 and to vertically extend may be provided at the center of the main body 10. The intermediate partition 17 may be formed by foaming an insulating member. The intermediate partition 17 may be formed between the inner box 11 of the refrigerator compartment 21 and an inner box 12 of the freezer compartment 22. The insulating member may include a urethane foam. Although the urethane foam is used for the intermediate partition 17 in the embodiment as an example for the sake of convenience in the description, the urethane foam may be used for all main body walls 18 disposed adjacent to the doors 30. In addition, although the refrigerator compartment 21 and the freezer compartment 22 are laterally disposed side by side in the embodiment, the intermediate partition 17 may be provided to horizontally extend in the refrigerator 1 in which the refrigerator compartment 21 and the freezer compartment 22 are vertically disposed.

A mid-frame 100 may be provided at front surfaces 11*aa* and 12*aa* of the intermediate partition 17. That is, the insulating member may be filled in an inside space formed by the inner boxes 11 and 12 of the intermediate partition 17 and the mid-frame 100.

The mid-frame 100 may be disposed at the front surfaces 11*aa* and 12*aa* of the intermediate partition 17.

The mid-frame 100 may increase a strength of the intermediate partition 17 by maintaining a high strength. In addition, heaters 140 which will be described below may be disposed inside the mid-frame 100, the mid-frame 100 may receive heat from the heaters 140, and a dew condensation phenomenon may be prevented from occurring at a front surface of the intermediate partition 17.

The mid-frame 100 may be formed to be long vertically to correspond to the intermediate partition 17. That is, the mid-frame 100 may be disposed in a longitudinal direction of the intermediate partition 17.

The heaters 140 are for preventing dew from forming at a portion in contact with the doors 30 due to a temperature difference between the storage compartment 20 of the refrigerator 1 and the outside of the refrigerator 1. The heaters 140 may be provided behind the mid-frame 100. The heaters 140 may supply heat to the mid-frame 100 and may prevent a dew condensation phenomenon from occurring at the mid-frame 100. Although three heaters 140 are provided inside the mid-frame 100 in the embodiment, the number of the heaters 140 is not limited thereto.

Each of the heaters 140 may include a heat pipe inside which a heated liquid flows. The heat pipe may be provided such that the heated liquid flows therein, and may be formed to be long in a longitudinal direction of the mid-frame 100. The liquid flowing in the heat pipe is not limited, and may receive heat by exchanging heat with the compressor 41.

The mid-frame 100 may include a front frame 110 and extension frames 120.

The front frame 110 is provided to cover the front surfaces 11*aa* and 12*aa* of the inner boxes 11 and 12 forming the refrigerator compartment 21 and the freezer compartment 22. The front frame 110 may be provided to cover at least a part of the inner boxes 11 and 12. Specifically, the inner box 11 of the refrigerator compartment 21 and the inner box 12 of the freezer compartment 22 may be provided to cover the front surfaces 11*aa* and 12*aa* with respect to a first inner box coupling portion 11*a* and a second inner box coupling portion 12*a* formed to face the inner boxes 11 and 12. Shapes of the first and second inner box coupling portions 11*a* and 12*a* are not limited, and the inner box coupling portions 11*a* and 12*a* may be formed in a shape of a flange along edges of the inner boxes 11 and 12 in the embodiment. The first and second inner box coupling portions 11*a* and 12*a* may form insertion grooves 13*a* in a concave shape open toward the front, and the heater 140 may be disposed in each of the concave insertion grooves 13*a*.

Each of the extension frames 120 may be provided to extend from the front frame 110. The extension frames 120 may be provided to face rear surfaces 11*ab* and 12*ab* of the first and second inner box coupling portions 11*a* and 12*a*. The front frame 110 and the extension frames 120 may support front, rear, and side surfaces of the first and second inner box coupling portions 11*a* and 12*a* through the above-described structure. In addition, the front frame 110 and each of the extension frames 120 may be temporarily coupled to each of the first and second inner box coupling portions 11*a* and 12*a* before the insulating member is foamed in the intermediate partition 17.

The mid-frame 100 may be formed by bending one panel. Accordingly, because the mid-frame 100 does not have a portion cut off in itself, heat is prevented from concentrating at a partial section.

The mid-frame 100 may include inner box insertion spaces 130. The inner box insertion spaces 130 may be formed between a rear surface of the front frame 110 and inner surfaces 121 in a direction in which the extension frames 120 are bent. The first and second inner box coupling portions 11*a* and 12*a* may be inserted into the inner box insertion spaces 130.

The extension frames 120 may include extending portions 122 and extensions portion 124.

Each of the extending portions 122 may be provided to extend rearward by being bent from the front frame 110. Each of the extensions portion 124 may be provided to face each of the rear surfaces 11*ab* and 12*ab* of the inner boxes 11 and 12 by being bent from the extending portion 122.

The extending portion 122 may be formed to extend from a rear surface 111 of the front frame 110 behind the front frame 110, and the extension 124 may be provided to be approximately parallel to the front frame 110 by being bent from the extending portion 122.

The extension frames 120 may include edges portion 126.

Each of the edges portion 126 may be formed at an end portion of the extension 124, and may be formed to have a thickness greater than that of an adjacent extension frame 120. Because the edges portion 126 are formed to have a thickness greater than that of the extension 124 of the extension frame 120 which will be described below, the edges portion 126 may stably support each of the rear surfaces 11*ab* and 12*ab* of the inner box coupling portions 11*a* and 12*a*. In addition, because the edges portion 126 are provided to be exposed toward each of the inner box insertion spaces 130, the edges portion 126 may stably support each of the rear surfaces 11*ab* and 12*ab* of the inner box coupling portions 11*a* and 12*a*.

The edges portion 126 may be variously formed and may include bent portions 127 formed by being bent such that the frame overlaps itself in the embodiment.

Each of the bent portions 127 may be formed at the end portion of the extension 124 and may be formed such that the bent portion is bent so as to overlap itself. That is, the bent portion 127 is one portion of the extension 124 and may be formed by bending the end portion such that the end portion overlaps itself. The bent portion 127 may be formed to face the inner box insertion space 130. Each of the rear surfaces of the inner box coupling portions 11*a* and 12*a* disposed in the inner box insertion space 130 may be supported through the above-described structure.

The bent portions 127 may be formed in the same longitudinal direction as that of the extension 124. That is, the bent portion 127 may be provided to be positioned on a line extending in the longitudinal direction of the extension 124. In addition, the bent portion 127 may be positioned to be closer to the front frame 110 than the extension 124.

The bent portion 127 may be bent such that the mid-frame 100 overlaps itself, and may be formed to have a thickness greater than that of the extension 124. The bent portions 127 may stably support each of the rear surfaces of the inner box coupling portions 11*a* and 12*a* through the above-described structure.

Heat generated from the heaters 140 is transferred to the front frame 110 and the extension frames 120. When the extension frame 120 is formed to be long, the heat is transferred to an inside of the intermediate partition 17, the heat is transferred to the storage compartment 20, and thus energy efficiency is severely decreased. Accordingly, an effect in which a length of the extension frame 120 is decreased may be achieved and radiation of heat to the storage compartment 20 may be minimized by the bent portion 127.

The bent portion 127 may be bent to overlap itself in a first direction w1 which is a front direction of the intermediate partition 17. Because the bent portion 127 is formed to overlap itself toward the front frame 110, heat transferred to the bent portion 127 may be re-transferred to the front frame 110.

Hereinafter, a heat transfer path in the refrigerator according to the embodiment will be described.

Heat generated by the heater 140 is transferred to the mid-frame 100. Specifically, the heater 140 transfers the heat to the front frame 110, and the heat transferred to the front frame 110 prevents a dew condensation phenomenon of the refrigerator 1. The heat of the front frame 110 may be thermally conducted to the extension frame 120, and then may be thermally conducted to the bent portion 127 of an end portion of the extension frame 120.

The bent portion 127 is a portion at which the mid-frame 100 is formed to overlap itself, and because the mid-frame 100 overlaps itself in the first direction w1, the heat transferred to the bending portion 127 is diffused more in the first direction w1 than in the surroundings.

Hereinafter, a refrigerator according to another embodiment will be described.

In the description of the embodiment, components that are the same as those of the previous embodiment will not be described.

Figure 4:
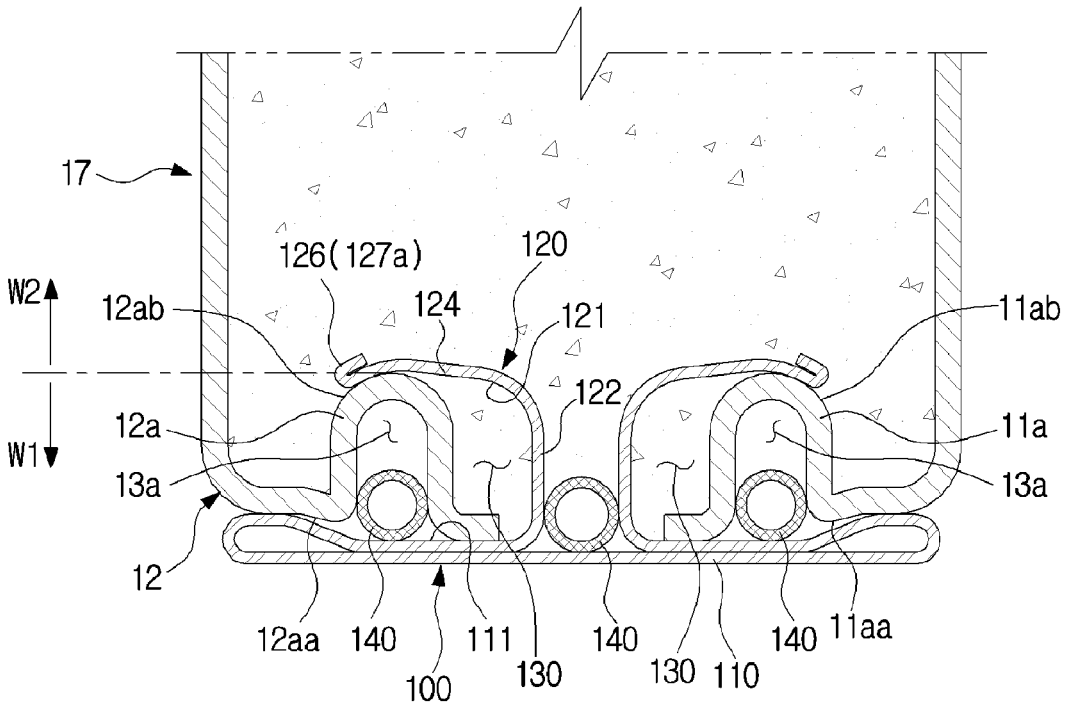
FIG. 4 is a cross-sectional view illustrating an intermediate partition of a refrigerator according to an embodiment of the disclosure.

FIG. 4 is a cross-sectional view illustrating an intermediate partition of a refrigerator according to another embodiment of the disclosure.

In the embodiment, a structure of a bent portion 127*a* is different from the bent portion of the previous embodiment.

Extension frames 120 may include bent portions 127*a*.

The bent portions 127*a* may be formed at end portions of extensions portion 124, and may be formed to be bent so as to overlap itself. Each of the bent portions 127*a* may be formed in the same longitudinal direction as that of each of the extensions portion 124.

The bent portion 127*a* may be bent such that a mid-frame 100 overlaps itself, and may be formed to have a thickness greater than that of an adjacent extension 124.

Heat generated by heaters 140 is transferred to a front frame 110 and the extension frames 120. When a length of each of the extension frames 120 is long, the heat is transferred to an inside of an intermediate partition 17 and to a storage compartment 20, and thus energy efficiency is dramatically decreased. Accordingly, the length of the extension frame 120 has to be decreased by the bent portion 127*a*, and first and second inner box coupling portions 11*a* and 12*a* have to be simultaneously and stably supported by the bent portions 127*a*.

A bending direction of the bent portion 127*a* may be a second direction w2 opposite to a first direction w1 which is a front direction of the intermediate partition 17, and the bent portion 127*a* may overlap itself in the second direction w2. That is, the bent portion 127*a* may be bent to overlap itself behind the mid-frame 100. Because the bent portions 127*a* are formed to overlap themselves, rear surfaces 11*ab* and 12*ab* of the first and second inner box coupling portions 11*a* and 12*a* may be stably supported.

Hereinafter, a refrigerator according to still another embodiment will described.

In the description of the embodiment, components that are the same as those of the previous embodiment will not be described.

Figure 5:
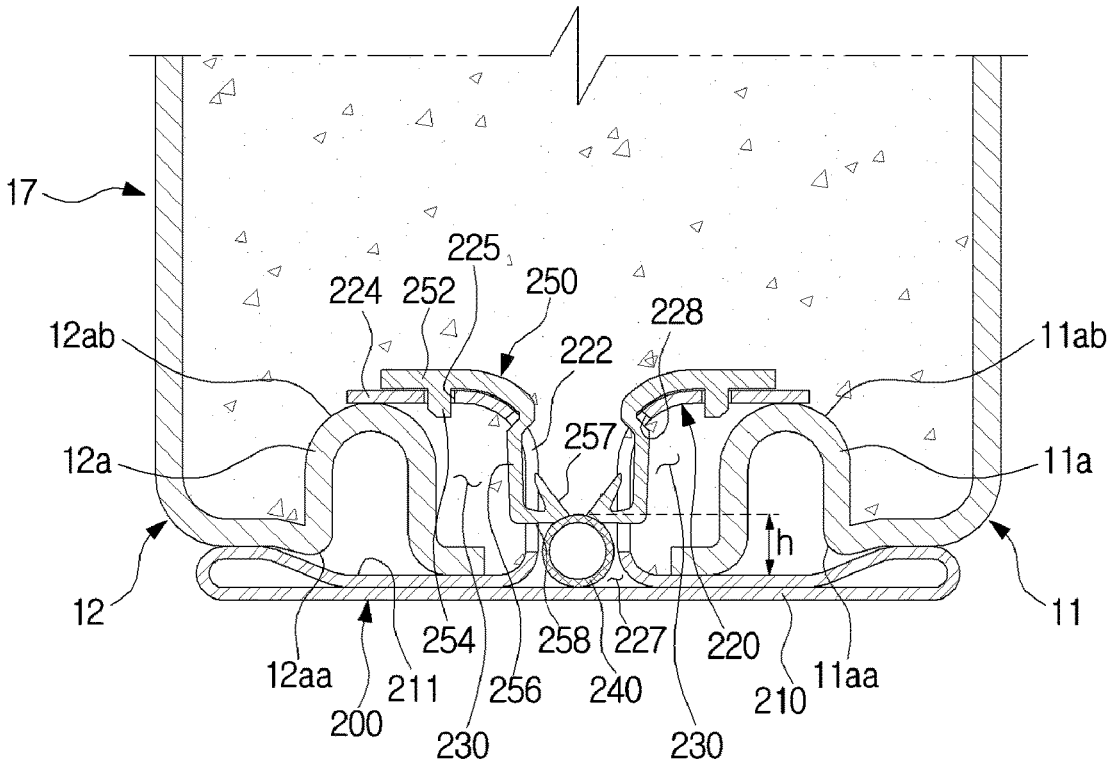
FIG. 5 is a cross-sectional view illustrating an intermediate partition of a refrigerator according to an embodiment of the disclosure.
Figure 6:
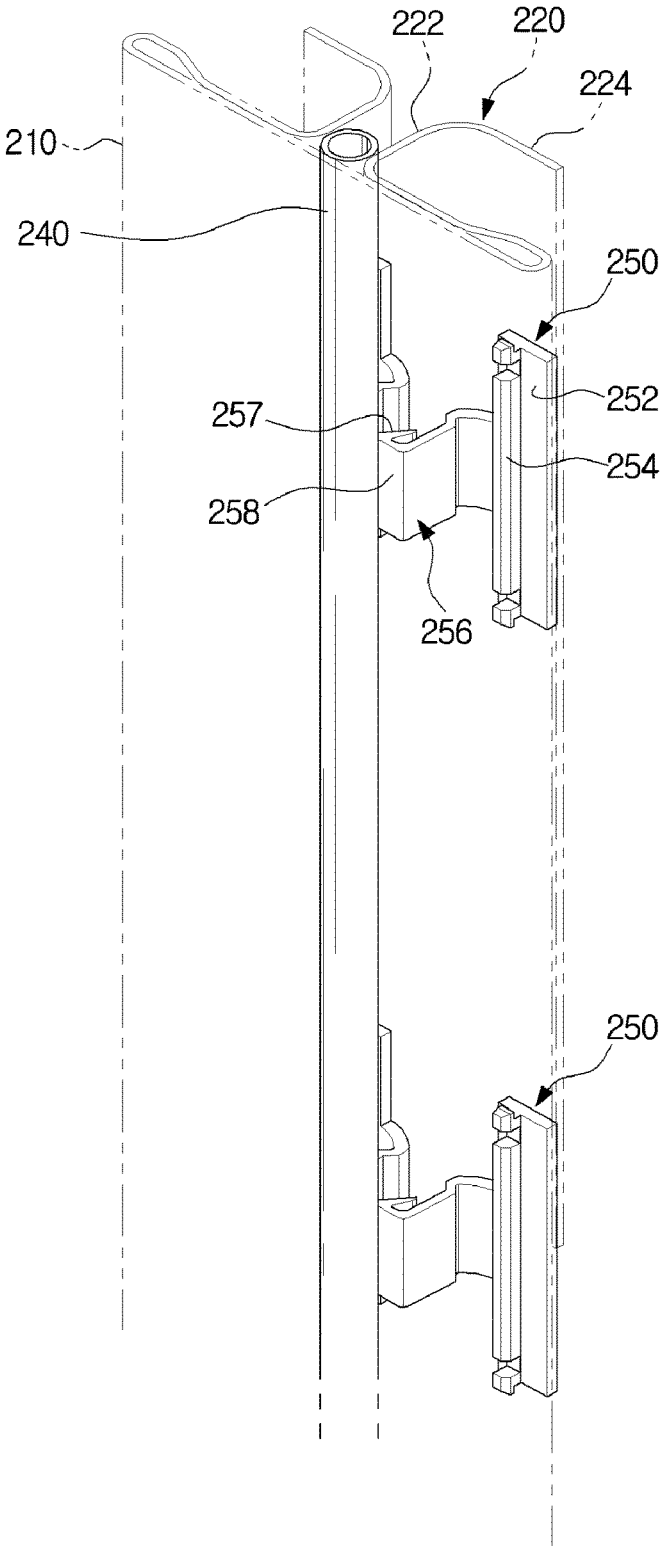
FIG. 6 is a perspective view illustrating a partial structure according to still another embodiment of the disclosure.
Figure 7:
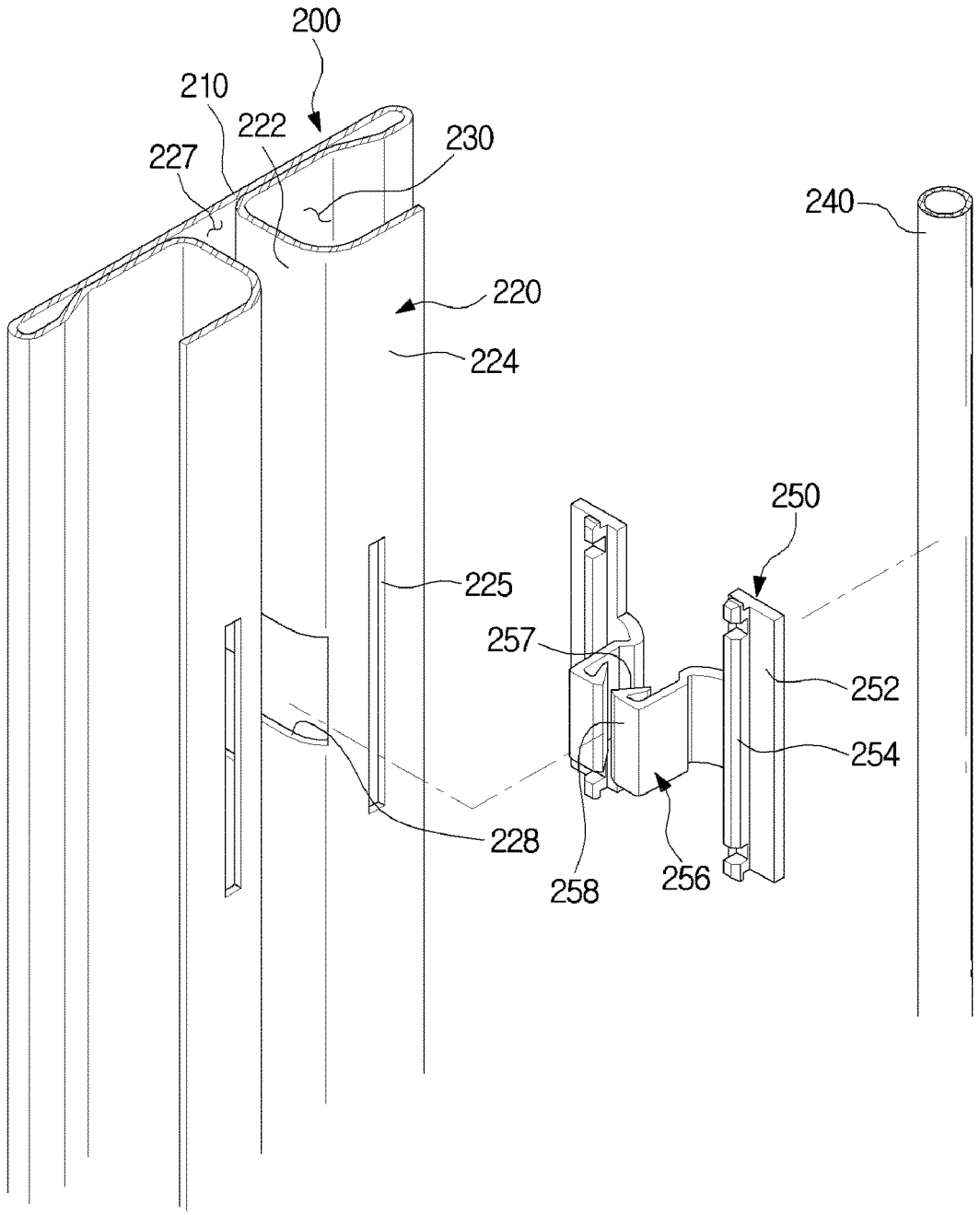
FIG. 7 is an exploded perspective view illustrating the partial structure according to an embodiment of the disclosure.

FIG. 5 is a cross-sectional view illustrating an intermediate partition of a refrigerator according to still another embodiment of the disclosure, FIG. 6 is a perspective view illustrating a partial structure according to still another embodiment of the disclosure, and FIG. 7 is an exploded perspective view illustrating the partial structure according to still another embodiment of the disclosure.

A mid-frame 200 may include a front frame 210 and extension frames 220.

A pair of extension frames 220 may be provided behind the front frame 210 so as to interpose a heater 240 therebetween. The pair of extension frames 220 may be formed to extend from the front frame 210 to be separated from each other. A seating space in which the heater 240 is seated may be formed between the pair of extension frames 220.

In the embodiment, one heater 240 is provided in a seating space 227 formed between the pair of extension frames 220. However, the number of heaters 240 is not limited, and a plurality of heaters 240 may be provided adjacent to the mid-frame 200. One heater 240 may be provided by being surrounded by the mid-frame 200. That is, because the heater 240 is disposed in the seating space 227 formed by the mid-frame 200 so as not to be in direct contact with an inner box 11, heat is not directly transferred to the inner box 11, and thus heat transfer to an inside of a storage compartment 20 may be minimized.

Pressers 250 may be provided at the mid-frame 200.

Each of the pressers 250 is provided to press the heater 240 such that the heater 240 is pressed against the mid-frame 200. The presser 250 may be detachably provided at the mid-frame 200. Specifically, the pressers 250 may be provided at extension frames 220 of the mid-frame 200.

The presser 250 may be provided at one or more of the pair of extension frames 220. In the embodiment, a pair of pressers 250 may be provided to correspond to the pair of extension frames 220. The presser 250 may be provided to press the heater 240 toward the mid-frame 200 by fixing at least a part of each of the pressers 250 to the extension frame 220.

A plurality of pressers 250 may be provided to be spaced apart from each other behind the front frame 210 in a longitudinal direction of the mid-frame 200. However, one presser 250 may be provided behind the front frame 210, and the number of pressers 250 is not limited.

The pressers 250 may include unit bodies 252, fixing portions 254, and pressing portions 256.

The unit body 252 forms a body of the presser 250 and is provided to be in contact with each of the extension frames 220.

Each of the fixing portions 254 is provided such that the presser 250 is fixed to the mid-frame 200. The fixing portion 254 is formed to extend from the unit body 252 and is provide such that the unit body 252 is fixed to the extension frame 220. Specifically, the fixing portion 254 is provided such that the unit body 252 is fixed to the extension frame 220 of the mid-frame 200.

The fixing portion 254 may be formed in a protruding shape, and a fixing groove 225 having a hole shape corresponding to the fixing portion 254 may be formed in the extension frame 220 such that the fixing portion 254 passes through the fixing grooves 225 and is hooked at and fixed to the extension frame 220. Although the fixing grooves 225 may be formed in extending portions 222 of the extension frames 220, the fixing grooves 225 are formed in extensions 224 in the embodiment. Because the fixing groove 225 is formed in each of the extensions 224, the presser 250 may be stably fixed while the presser 250 laterally moves. Although the fixing portion 254 is formed in a protruding shape in the embodiment, the fixing portion 254 may be formed in a hooked-shape and may be hooked to the fixing groove 225. A shape of the fixing portion is not limited.

Each of the pressing portions 256 is provided to press the heater 240 toward the mid-frame 200. Specifically, the pressing portion 256 presses the heater 240 toward a rear surface 211 of a front frame 210 of the mid-frame 200. Because the pressing portion 256 presses the heater 240 toward the front frame 210 as described above, the heater 240 is pressed against the rear surface 211 of the front frame 210, and thus a heat transfer efficiency from the heater 240 may be increased.

The pressing portion 256 may be formed to extend from the unit body 252 and may be provided to elastically operate with respect to the unit body 252. That is, the pressing portion 256 may elastically move from the unit body 252 and may press the heater 240 toward the front frame 210. The pressing portion 256 may include an elastic material, but is not limited thereto, and all of the presser 250 in addition to the pressing portion 256 may be formed of the elastic material.

Hole-shaped frame openings 228 may be formed in the extension frames 220 so as to form a space in which the pressing portions 256 are elastically deformed with respect to the unit bodies 252. Each of the frame openings 228 may be formed in the extending portion 222.

The pressing portions 256 may include insertion surfaces 257 and pressing surfaces 258.

Each of the insertion surfaces 257 is provided to guide the heater 240 to the seating space 227. When the heater 240 is inserted into the seating space 227, the heater 240 moves along the insertion surface 257. In this process, a pair of pressing portions 256 are elastically deformed in both directions, and when the heater 240 is seated in the seating space 227, the pair of pressing portions 256 elastically return to a normal state. Because the pair of pressers 250 are provided, a pair of insertion surfaces 257 are also provided to face each other and guide the heater 240 to be inserted into the seating space 227 by the heater 240 being passed between the pair of insertion surfaces 257. A gap between the pair of insertion surfaces 257 is provided to decrease in a direction in which the heater 240 is inserted into the seating space 227.

The elastically returned pressing portions 256 may press the heater 240 toward the rear surface 211 of the front frame 210 using each of the pressing surfaces 258. The pressing surface 258 may be formed at a surface opposite the insertion surface 257 in the pressing portion 256.

The pressing portion 256 is provided to be elastically deformed such that the pressing surface 258 is pressed against the heater 240. Because the pair of pressing portions 256 are provided at both sides of the seating space 227, the heater 240 is stably pressed toward the rear surface of the front frame 210. Although the pair of pressing portions 256 are provided and press both sides of the heater 240 in the embodiment, the pressing portion is not limited thereto, and the presser 250 may be disposed only at one of the pair of extension frames 220 and may press the heater 240 toward the rear surface of the front frame 210.

A distance h between the pressing portion 256 and the rear surface 211 of the front frame 210 may be less than a thickness t of the heater 240. Because the distance h is less than the thickness t, the pressing portion 256 may efficiently press the heater 240 seated in the seating space 227 toward the rear surface 211 of the front frame 210.

Hereinafter, an arrangement between components and a manufacturing method of the refrigerator 1 according to the embodiment will be described.

Figure 8:
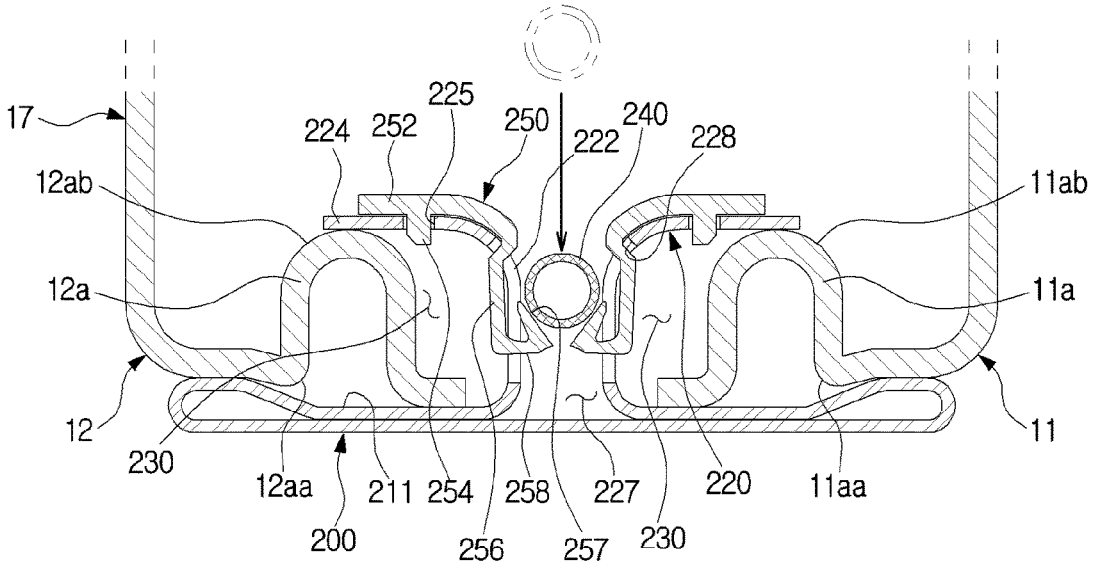
FIGS. 8 to 10 are views illustrating operations of the presser when the heater is installed according to an embodiment of the disclosure.
Figure 9:
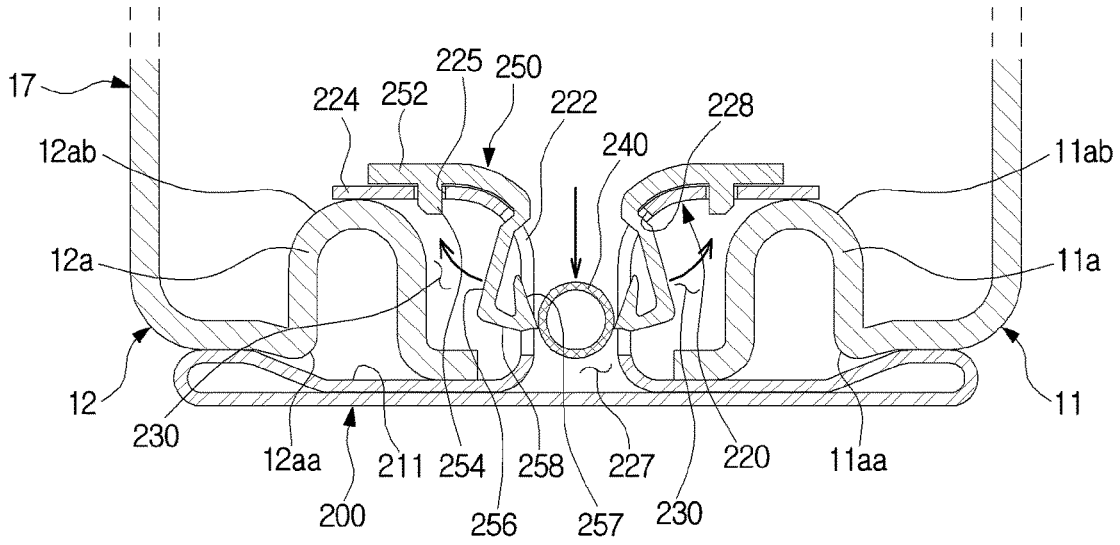
Figure 10:
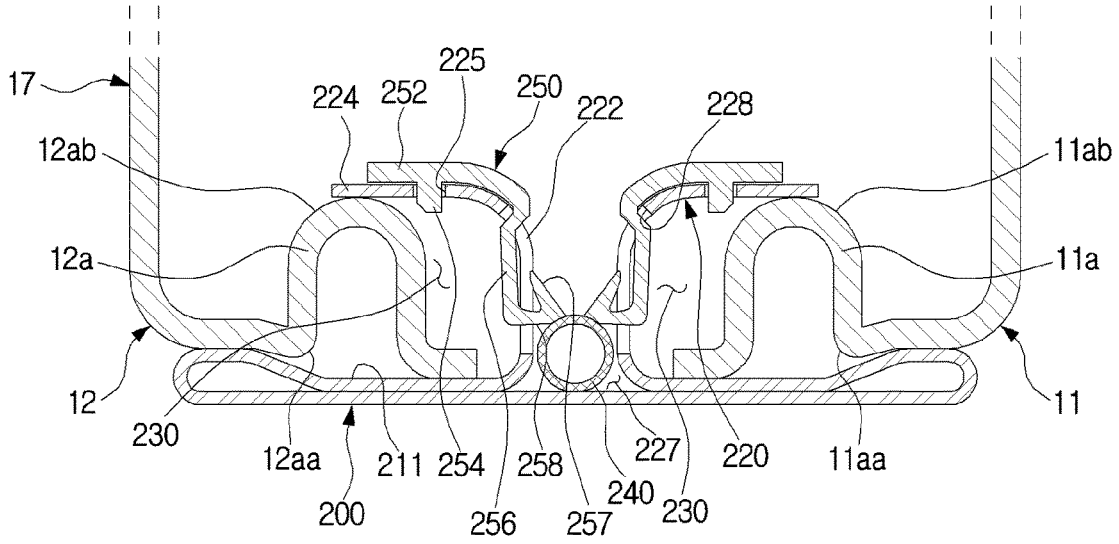

FIGS. 8 to 10 are views illustrating operations of the presser when the heater is installed according to still another embodiment of the disclosure.

The mid-frame 200 may cause components to be temporarily coupled to each other between the inner box 11 of a refrigerator compartment 21 and an inner box 12 of a freezer compartment 22. Specifically, the mid-frame 200 and the inner boxes 11 and 12 may be coupled by inserting the inner boxes 11 and 12 into an inner box insertion space 230 formed at the mid-frame 200.

The heater 240 is formed to be long in a longitudinal direction of the mid-frame 200 and is inserted into the seating space 227 of the mid-frame 200. When the heater 240 is pressed after being positioned at the insertion surfaces 257 of the pressers 250, the pressing portions 256 of the presser 250 are elastically deformed in both directions and the heater 240 is inserted into the seating space 227.

After the heater 240 is inserted into the seating space 227, the pressing surfaces 258 of the pressing portions 256 press the heater 240 such that the heater 240 is pressed against the rear surface of the front frame 210.

Then, an intermediate partition 17 is formed by foaming an insulating member between the mid-frame 200 and the inner boxes 11 and 12.

Hereinafter, a refrigerator 1 according to yet another embodiment will be described.

In the description of the embodiment, components that are the same as those of the previous embodiment will not be described.

Figure 11:
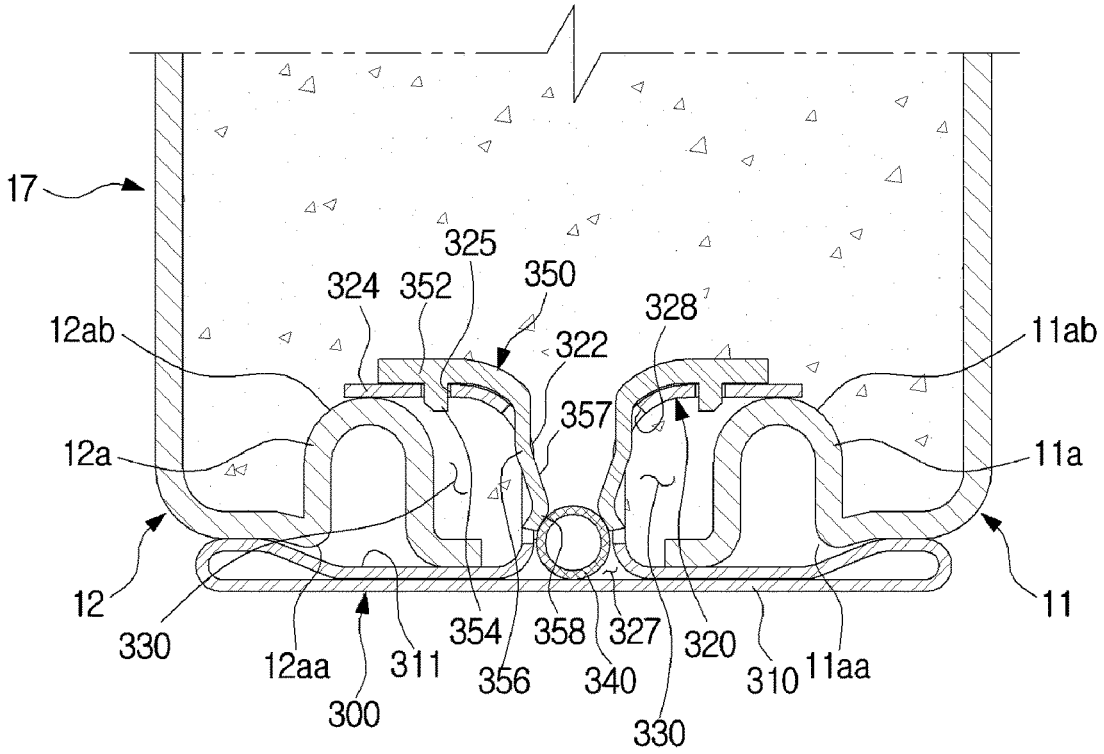
FIG. 11 is a cross-sectional view illustrating an intermediate partition of a refrigerator according to an embodiment of the disclosure.
Figure 12:
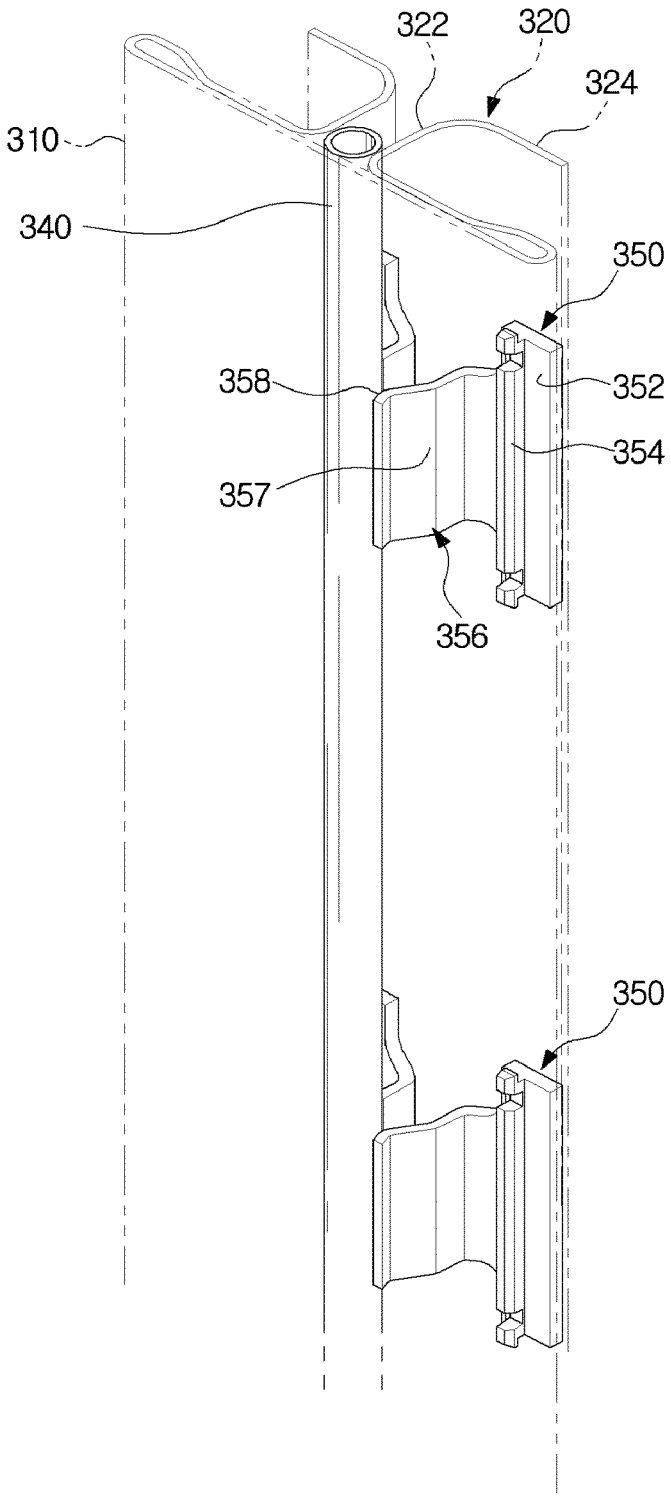
FIG. 12 is a perspective view illustrating a partial structure according to an embodiment of the disclosure.
Figure 13:
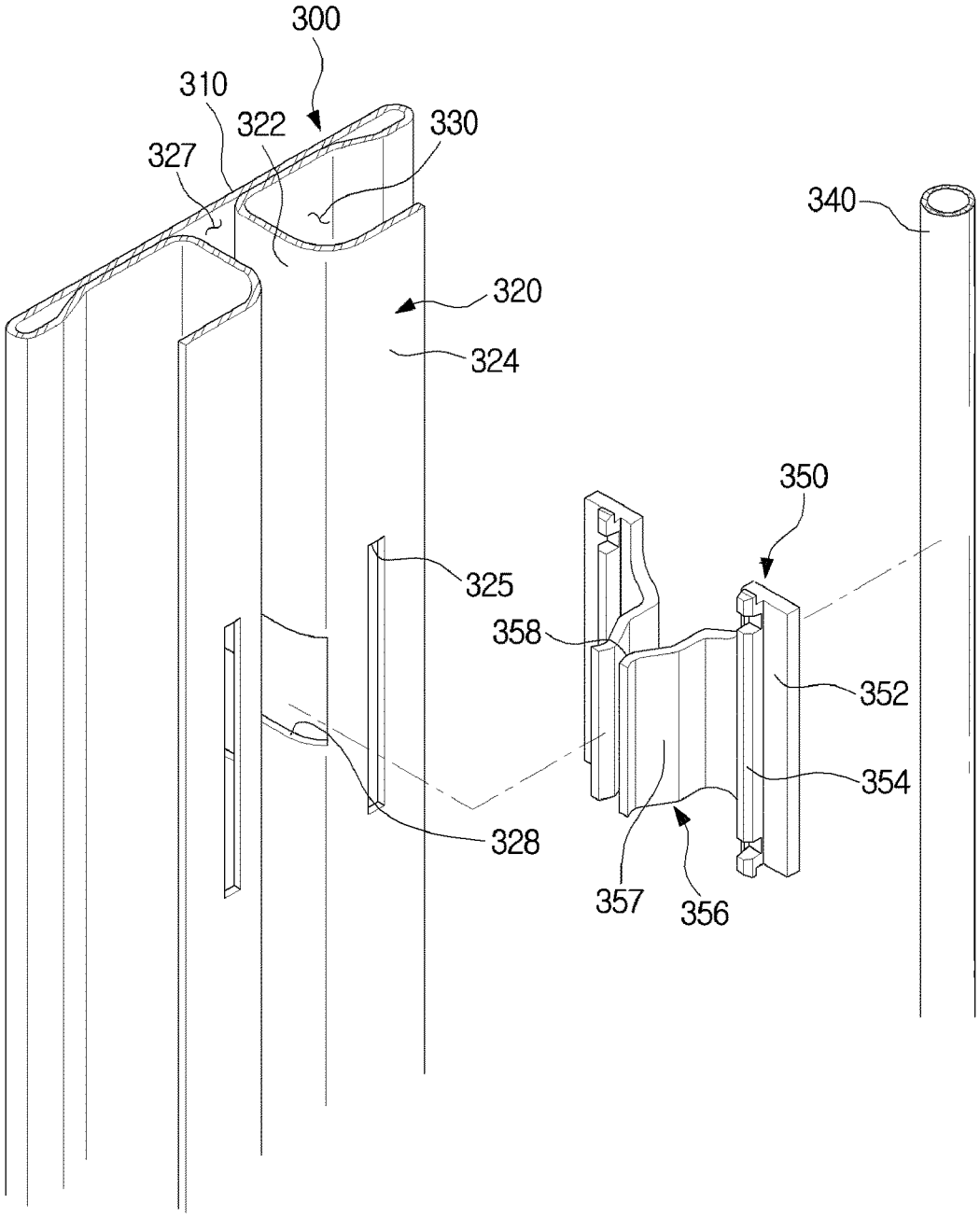
FIG. 13 is an exploded perspective view illustrating the partial structure according to an embodiment of the disclosure.

FIG. 11 is a cross-sectional view illustrating an intermediate partition of a refrigerator according to yet another embodiment of the disclosure, FIG. 12 is a perspective view illustrating a partial structure according to yet another embodiment of the disclosure, and FIG. 13 is an exploded perspective view illustrating the partial structure according to yet another embodiment of the disclosure.

Pressers 350 may be provided at a mid-frame 300.

Each of the pressers 350 is provided to press a heater 340 such that the heater 340 is pressed against the mid-frame 300. The presser 350 may be detachably provided at the mid-frame 300. Specifically, the pressers 350 may be provided at extension frames 320 of the mid-frame 300. A pair of pressers 350 may be provided to correspond to a pair of extension frames 320.

The pressers 350 may include unit bodies 352, fixing portions 354, and pressing portions 356.

The unit body 352 forms a body of the presser 350 and is provided to be in contact with the extension frames 320.

Each of the fixing portions 354 is provided such that the presser 350 is fixed to the mid-frame 300. The fixing portion 354 is formed to extend from the unit body 352 and is provided such that the unit body 352 is fixed to the extension frame 320. Specifically, the fixing portion 354 is provided such that the unit body 352 is fixed to the extension frame 320 of the mid-frame 300.

The fixing portion 354 may be formed in a hooked-shape, hole-shaped fixing grooves 325 and corresponding to the fixing portions 354 may be formed in the extension frames 320 such that the fixing portion 354 passes through the fixing grooves 325 and is hooked at and fixed to the extension frame 320. Although the fixing grooves 325 may be formed in extending portions 322 of the extension frames 320, the fixing grooves 325 are formed in extensions 324 in the embodiment. Because the fixing groove 325 is formed in each of the extensions 324, the presser 350 may be stably fixed while the presser 350 laterally moves.

Each of the pressing portions 356 is provided to press the heater 340 toward the mid-frame 300. Specifically, the pressing portion 356 presses the heater 340 toward a rear surface 311 of a front frame 310 of the mid-frame 300. Because the pressing portion 356 presses the heater 340 toward the front frame 310 as described above, the heater 340 is pressed against the rear surface 311 of the front frame 310, and thus a heat transfer efficiency from the heater 340 may be increased.

The pressing portion 356 may be formed to extend from the unit body 352 and may be provided to elastically operate with respect to the unit body 352. The pressing portion 356 may be formed in a curved-panel shape and may press the heater 340 toward one side surface of the pressing portion 356. Hole-shaped frame openings 328 may be formed in the extension frames 320 so as to form a space in which the pressing portion 356 is elastically deformed with respect to the unit body 352. Each of the frame openings may be formed in the extending portion 322.

The pressing portions 356 may include insertion surfaces 357 and pressing surfaces 358.

Each of the insertion surfaces 357 is provided to guide the heater 340 to the seating space 327. When the heater 340 is inserted into the seating space 327, the heater 340 moves along the insertion surface 357. In this process, a pair of pressing portions 356 are elastically deformed in both directions, and when the heater 340 is seated in the seating space 327, the pair of pressing portions 356 elastically return to the normal state. Because the pair of pressers 350 are provided, a pair of insertion surfaces 357 are provided to face each other and guide the heater 340 to be inserted into the seating space 327 by the heater 340 being passed between the pair of insertion surfaces 357. A gap between the pair of insertion surfaces 357 is provided to decrease in a direction in which the heater 340 is inserted into the seating space 327.

The elastically returned pressing portion 356 may press the heater 340 toward the rear surface 311 of the front frame 310 using each of the pressing surfaces 358. The pressing surface 358 is formed to extend from the insertion surface 357 and is provided to be bent at a predetermined angle with respect to the insertion surface 357.

The gap between the pair of insertion surfaces 357 is provided to decrease in a direction in which the heater 240 is inserted into the seating space 227, and a gap between a pair of pressing surfaces 358 is provided to be increased.

The pressing portion 356 is provided to be elastically deformed such that the pressing surface 358 is pressed against the heater 340. Because the pair of pressing portions 356 are provided at both sides of the seating space 327, the heater 340 is stably pressed toward the rear surface 311 of the front frame 310. Although the pair of pressing portions 356 are provided and press both sides of the heater 340 in the embodiment, the pressing portion is not limited thereto, and the presser 350 may be disposed only at one of the pair of extension frames 320 and may press the heater 340 toward the rear surface of the front frame 310.

A distance H between the pressing portion 356 and the rear surface 311 of the front frame 310 may be less than a thickness T of the heater 340. Because the distance H is less than the thickness T, the pressing portion 356 may efficiently press the heater 340 seated in the seating space 327 toward the rear surface of the front frame 310.

Hereinafter, an arrangement between components and a manufacturing method of the refrigerator 1 according to the embodiment will be described.

The mid-frame 300 may cause components to be temporarily coupled to each other between an inner box 11 of a refrigerator compartment 21 and an inner box 12 of a freezer compartment 22. Specifically, the mid-frame 300 and the inner boxes 11 and 12 may be coupled by inserting the inner boxes 11 and 12 into an inner box insertion space 330 formed at the mid-frame 300.

The heater 340 is formed to be long in a longitudinal direction of the mid-frame 300 and is inserted into the seating space 327 of the mid-frame 300. When the heater 340 is pressed after being positioned at the insertion surface 357 of the pressers 350, the pressing portions 356 of the pressers 350 are elastically deformed in both directions and the heater 340 is inserted into the seating space 327.

After the heater 340 is inserted into the seating space 327, the pressing surface 358 of the pressing portion 356 presses the heater 340 such that the heater 340 is pressed against the rear surface of the front frame 310.

Then, an intermediate partition 17 is formed by foaming an insulating member between the mid-frame 300 and the inner boxes 11 and 12.

Hereinafter, a refrigerator according to yet another embodiment will be described.

In the description of the embodiment, components that are the same as those of the previous embodiment will not be described.

Figure 14:
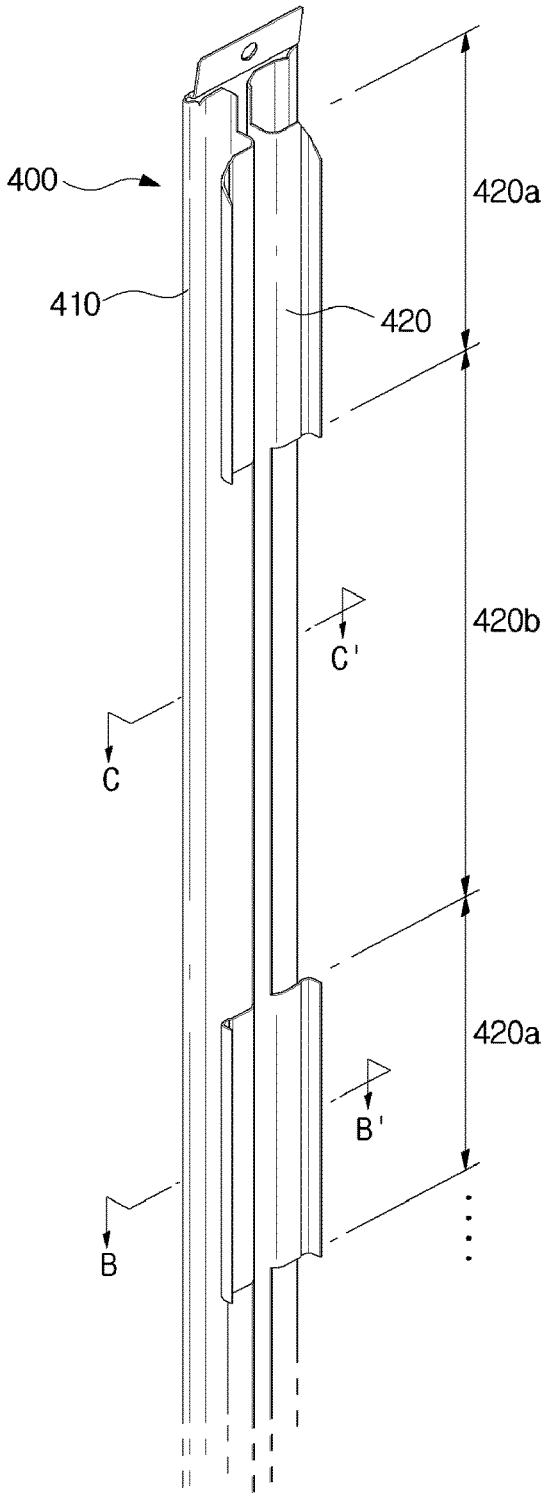
FIG. 14 is a perspective view illustrating a mid-frame according to an embodiment of the disclosure.
Figure 15:
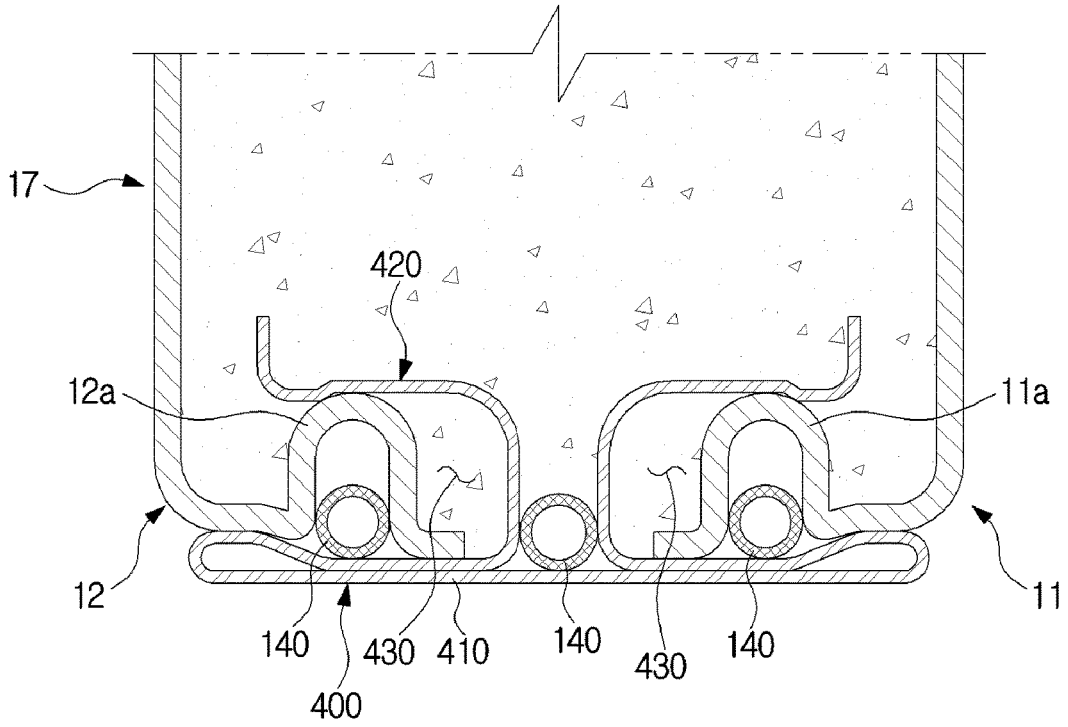
FIG. 15 is a cross-sectional view taken along line B-B' of FIG. 14.
Figure 16:
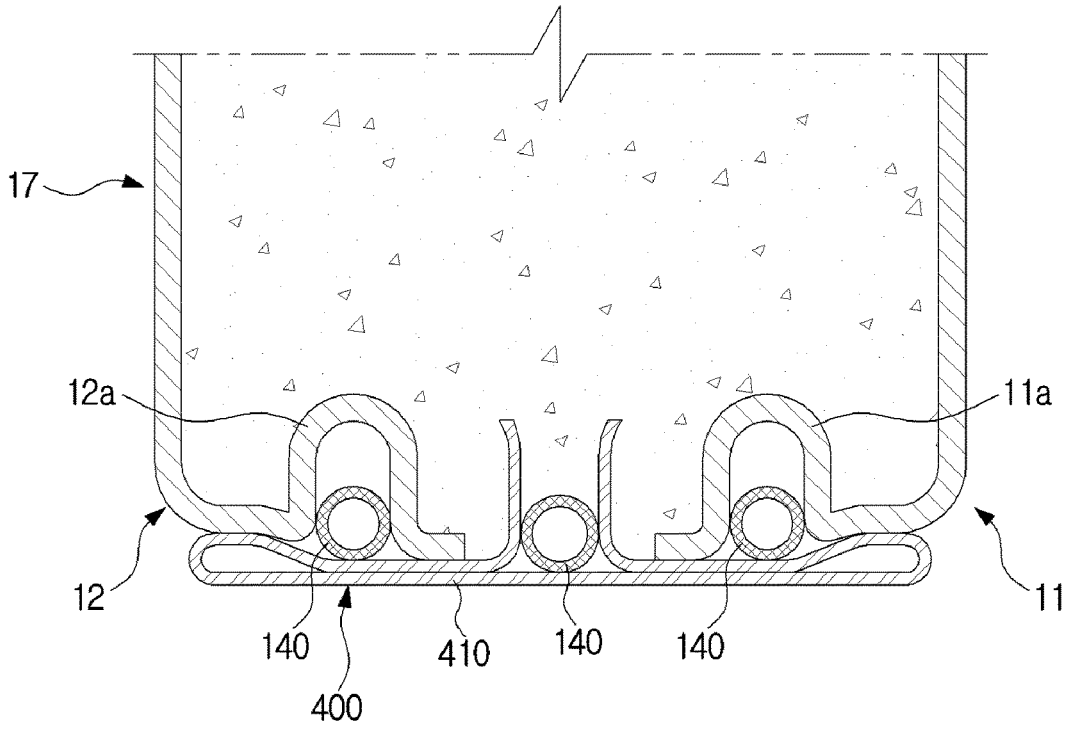
FIG. 16 is a cross-sectional view taken along line C-C' of FIG. 14.

FIG. 14 is a perspective view illustrating a mid-frame according to yet another embodiment of the disclosure, FIG. 15 is a cross-sectional view taken along line B-B' of FIG. 14, and FIG. 16 is a cross-sectional view taken along line C-C' of FIG. 14.

A mid-frame 400 may include a front frame 410 and extension frames 420.

The front frame 410 is provided to cover a front surface of an inner box 11 forming a refrigerator compartment 21 and a freezer compartment 22. Specifically, the inner box 11 of the refrigerator compartment 21 and an inner box 12 of the freezer compartment 22 may include a first inner box coupling portion 11*a* and a second inner box coupling portion 12*a* formed at portions facing the inner boxes 11 and 12. The front frame 410 may be provided to cover front surfaces of the first inner box coupling portion 11*a* and the second inner box coupling portion 12*a*.

Each of the extension frames 420 may be provided to extend to the front frame 410. The extension frames 420 may be provided to face rear surfaces of the first and second inner box coupling portions 11*a* and 12*a*. The front frame 410 and the extension frames 420 may support front, rear, and side surfaces of the first and second inner box coupling portions 11*a* and 12*a* through above-described structure. In addition, the front frame 410 and the extension frame 420 may be temporarily coupled to the first and second inner box coupling portions 11*a* and 12*a* before an insulating member is foamed in an intermediate partition 17.

The mid-frame 400 may include inner box insertion spaces 430. Each of the inner box insertion spaces 430 may be formed between a rear of the front frame 410 and an inside of the extension frame 420 in a bending direction. The first and second inner box coupling portions 11*a* and 12*a* may be respectively inserted into the inner box insertion spaces 430.

In the embodiment, the extension frame 420 may be formed in only at least a partial section of an entire section in a longitudinal direction of the mid-frame 400. That is, the extension frame 420 may be formed behind the front frame 410 and may be formed in at least a partial section of the entire section of the front frame 410.

A plurality of extension frames 420 are disposed to be space apart from each other.

In the embodiment, extending portions 422 are formed in an entire section of the mid-frame 400 to correspond to the entire section of the front frame 410, and extensions 424 are formed in only a plurality of partial sections of the entire section of the front frame 410.

The mid-frame 400 may include, in a longitudinal direction of the front frame 410, a first section 420*a* in which the extension frame 420 is formed behind the front frame 410, and a second section 420*b* which is adjacent to the first section 420*a* in a longitudinal direction and in which the extension frame 420 is not formed. The first section 420*a* and the second section 420*b* may be repeatedly formed behind the front frame 410.

Through such a structure, an amount of heat transferred from heaters 140 to the extension frames 420 may be decreased in a state in which the mid-frame 400 is temporarily capable of being coupled to the inner box 11. That is, heat transfer to the intermediate partition 17 or an inside of a storage compartment 20 may be minimized by decreasing an area at which the extension frame 420 is in contact with the intermediate partition 17.

Hereinafter, a refrigerator according to yet another embodiment will be described.

In the description of the embodiment, components that are the same as those of the previous embodiment will not be described.

Figure 17:
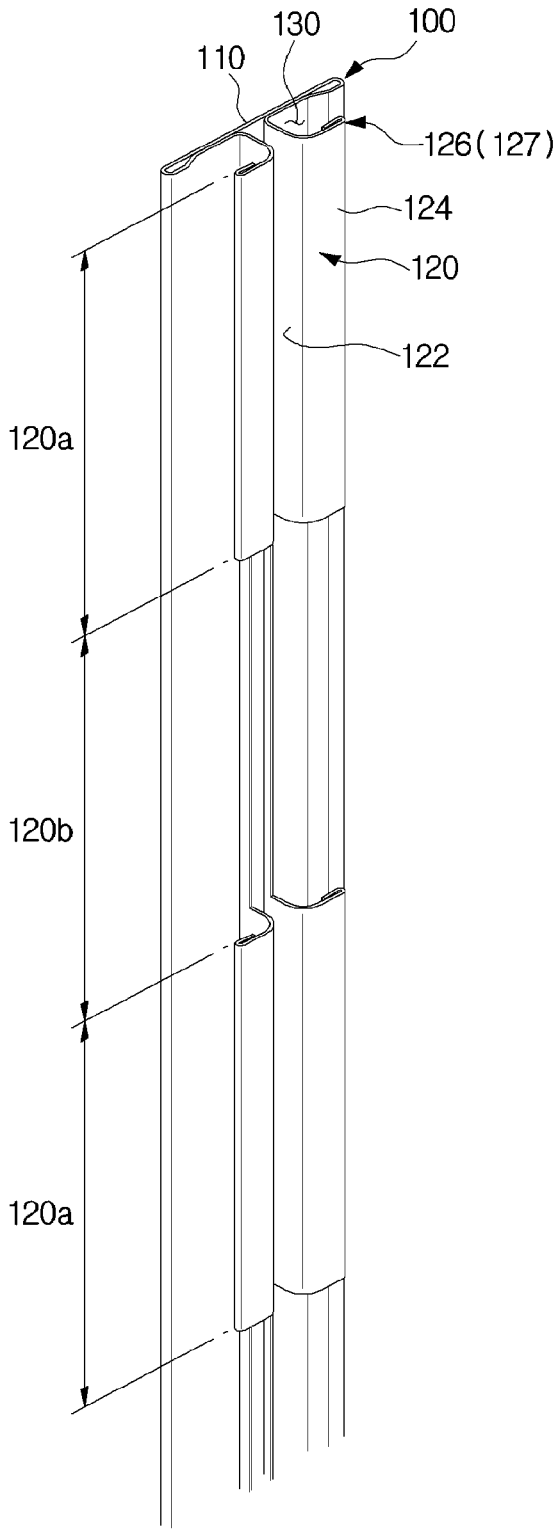
FIG. 17 is a perspective view illustrating a mid-frame according to an embodiment of the disclosure.

FIG. 17 is a perspective view illustrating a mid-frame according to yet another embodiment of the disclosure.

In the embodiment of FIG. 3, an extension frame 120 may be formed in only a partial section of an entire section in a longitudinal direction of a front frame 110.

Specifically, a mid-frame 100 may include, in the longitudinal direction of the front frame 110, a first section 120*a* in which the extension frame 120 is formed behind the front frame 110, and a second section 120*b* which is adjacent to the first section 120*a* in the longitudinal direction and in which the extension frame 120 is not formed. The first section 120*a* and the second section 120*b* may repeatedly be formed behind the front frame 110.

A section in which the extension frame 120 is disposed may be repeatedly disposed, or the extending portion 122 of the extension frame 120 may also be formed in an entire section of the mid-frame 100 to correspond to an entire section of the front frame 110, and the extension 124 may also be formed in a plurality of partial sections of the entire section of the front frame 110 as in the above-described embodiment.

Hereinafter, a refrigerator according to yet another embodiment will be described.

In the description of the embodiment, components that are the same as those of the previous embodiment will not be described.

Figure 18:
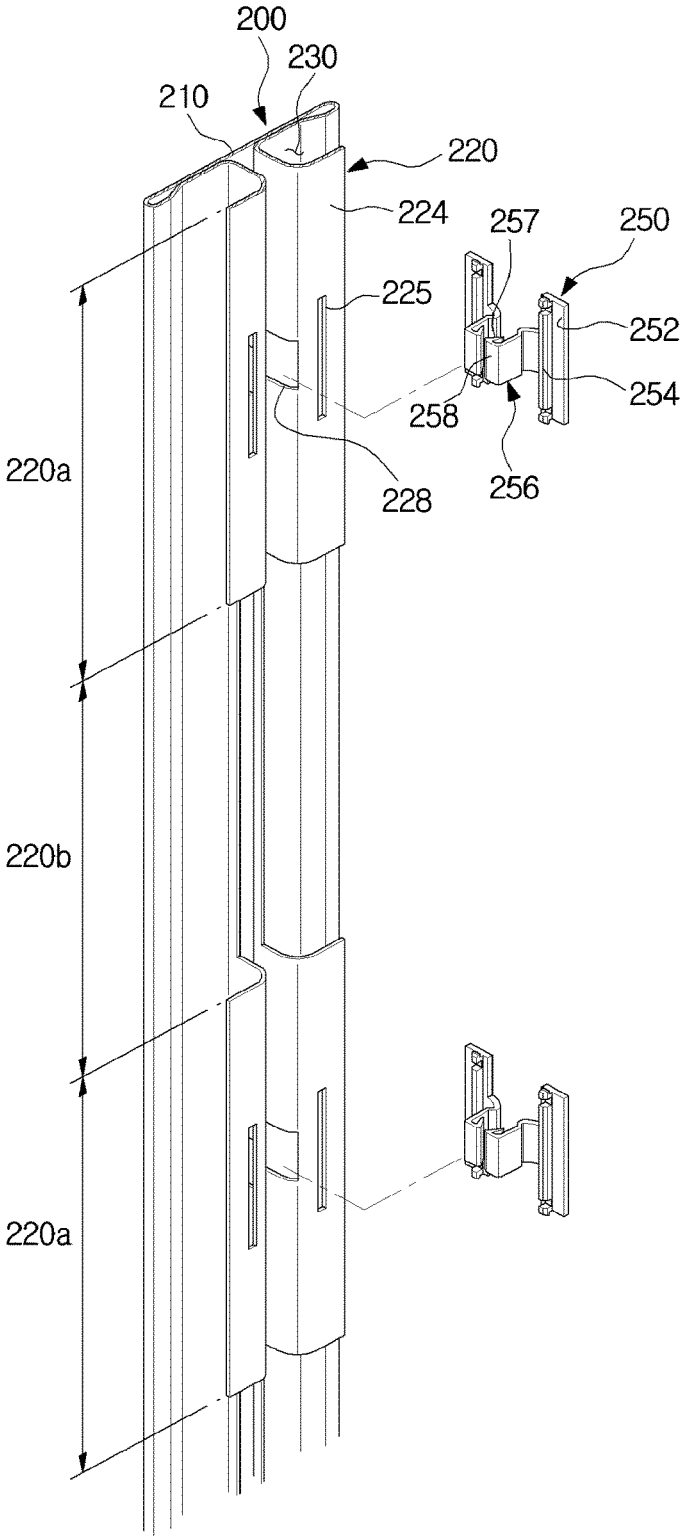
FIG. 18 is a perspective view illustrating a mid-frame according to an embodiment of the disclosure.

FIG. 18 is a perspective view illustrating a mid-frame according to yet another embodiment of the disclosure.

In the embodiment of FIGS. 5 to 7, the extension frame 220 may be formed in only at least a partial section of the entire section of the front frame 210 in the longitudinal direction.

Specifically, the mid-frame 200 may include, in the longitudinal direction of the front frame 210, a first section 220*a* in which the extension frame 220 is formed behind the front frame 210, and a second section 220*b* which is adjacent to the first section 220*a* in the longitudinal direction and in which the extension frame 220 is not formed. The first section 220*a* and the second section 220*b* may be repeatedly formed behind the front frame 210.

A section in which the extension frame 220 is disposed may be repeatedly disposed, or the extending portion 222 of the extension frame 220 may also be formed in an entire section of the mid-frame 200 to correspond to an entire section of the front frame 210 and the extension 224 may only be formed in a plurality of partial sections of the entire section of the front frame 110 as in the above-described embodiment.

As is apparent from the above description, a refrigerator in accordance with one or more embodiments of the disclosure can increase an energy efficiency by minimizing heat penetration inside the refrigerator.

A refrigerator in accordance with one or more embodiments of the disclosure can prevent a dew condensation phenomenon of the outside of the refrigerator.

A refrigerator in accordance with one or more embodiments of the disclosure can prevent heat penetration inside the refrigerator by increasing a heat transfer efficiency.

While example embodiments of the disclosure have been illustrated and described above in detail, the embodiments may be variously modified by those skilled in the art without departing from the gist of the technological scope of the disclosure defined by the appended claims and their equivalents.

What is claimed is:

1. A refrigerator, comprising:

a refrigerator main body including at least one inner box corresponding to at least one storage compartment;

a main body wall, having at least one surface including a front surface; and a mid-frame positioned on the front surface of the main body wall, the mid-frame including:

a front frame disposed to cover at least a part of a front surface of the at least one inner box and being elongated in a longitudinal direction, the front frame including:

a first section having an extension frame disposed to extend rearward from the front frame and including an edge portion disposed at an end of an extension portion of the extension frame having a thickness greater than that of the extension portion, a second section, spaced apart from the first section in the longitudinal direction, having another extension frame disposed to extend rearward from the front frame and including another edge portion disposed at another end of another extension portion of the another extension frame having a thickness greater than that of the another extension portion, and a third section, disposed between the first section and the second section in the longitudinal direction, in which no extension frame is disposed.

2. The refrigerator of claim 1, wherein the edge portion includes a bent portion bent such that the end of the extension portion of the extension frame overlaps itself.

3. The refrigerator of claim 1, wherein:

the mid-frame further includes an inner box insertion space disposed between a rear surface of the front frame and an inner surface of the mid-frame in a direction in which the extension frame is bent, and into which a part of the at least one inner box is inserted, and the edge portion is disposed to face the inner box insertion space.

4. The refrigerator of claim 3, wherein:

the at least one inner box includes an inner box coupling portion positioned in front of the main body wall and inserted into the inner box insertion space; and the edge portion is disposed to support a rear surface of the inner box coupling portion.

5. The refrigerator of claim 3, wherein:

the at least one inner box includes an inner box coupling portion positioned in front of the main body wall and inserted into the inner box insertion space, and the extension frame further includes:

an extending portion bent from the front frame and configured to extend rearward, and the edge portion is bent from the extending portion and faces a rear surface of the inner box coupling portion.

6. The refrigerator of claim 5, wherein the edge portion includes a bent portion bent such that the end of the extension portion of the extension frame overlaps itself.

7. The refrigerator of claim 2, wherein the bent portion is bent to overlap itself in a direction towards the front frame or in a direction away from the front frame.

8. The refrigerator of claim 2, wherein the bent portion is disposed closer to the front frame than the extension portion.

9. The refrigerator of claim 2, wherein the bent portion and the extension portion are elongated in a same longitudinal direction.

10. The refrigerator of claim 2, wherein at least a part of the bent portion is in contact with a rear surface of the at least one inner box.

11. The refrigerator of claim 1, wherein the extension frame is disposed in at least a partial section of an entire section of the front frame in a longitudinal direction of the front frame.

12. A refrigerator, comprising:

a refrigerator main body including inner boxes respectively corresponding to a freezer compartment and a refrigerator compartment;

an intermediate partition disposed between the inner boxes; and a mid-frame positioned on a front surface of the intermediate partition, the mid-frame including:

a front frame disposed to cover at least parts of front surfaces of the inner boxes, a pair of extension frames disposed to extend rearward from the front frame, a first bent portion extending laterally from a first extension frame among the pair of extension frames, and including a first end portion that overlaps with itself, and a first inner box insertion space disposed between a rear surface of the front frame and the first bent portion, wherein one of the inner boxes includes a first inner box coupling portion disposed in the first inner box insertion space such that the first bent portion supports a rear surface of the first inner box coupling portion, and a point at which the first bent portion is bent so as to have the first end portion overlap with itself does not extend beyond the first inner box coupling portion in the lateral direction.

13. The refrigerator of claim 12, wherein:

the mid-frame further includes:

a second bent portion extending laterally from a second extension frame among the pair of extension frames, and including a second end portion that overlaps with itself, and a second inner box insertion space disposed between the rear surface of the front frame and the second bent portion.

14. The refrigerator of claim 13, wherein:

another of the inner boxes includes a second inner box coupling disposed in the second inner box insertion space such that the second bent portion supports a rear surface of the second inner box coupling portion, and a point at which the first bent portion is bent so as to have the second end portion overlap with itself does not extend beyond the second inner box coupling portion in the lateral direction.

15. A refrigerator, comprising:

a main body including inner boxes and an intermediate partition disposed between the inner boxes;

a mid-frame disposed on a front surface of the intermediate partition and including a front frame and first and second extension frames that extend from the front frame in a rearward direction;

a heater configured to heat the mid-frame and disposed to the rear of the front frame and between the first and second extension frames; and first and second pressers respectively attached to the first and second extension frames and configured to press the heater toward the front frame, each of the first and second pressers including:

a pressing surface disposed at a rear surface of the heater, and an insertion surface extending from the pressing surface in a rearward direction such that a gap between the insertion surfaces of the first and second pressers increases in the rearward direction.

16. The refrigerator of claim 15, wherein the pressing surface for each of the first and second pressers and the front frame are elongated in a longitudinal direction substantially parallel to one another.

17. The refrigerator of claim 15, wherein the pressing surface for the first presser is inclined in the rearward direction differently than the pressing surface for the second presser such that a gap between the pressing surfaces of the first and second pressers decreases in the rearward direction.

* * * * *